US008337679B2

(12) United States Patent
Jickling et al.

(10) Patent No.: US 8,337,679 B2
(45) Date of Patent: Dec. 25, 2012

(54) ELECTROLYTIC CATHODE ASSEMBLIES AND METHODS OF MANUFACTURING AND USING SAME

(75) Inventors: Robert Stanley Jickling, Georgetown (CA); Gordon Steven Iverson, Oakville (CA)

(73) Assignee: EPCM Services Ltd., Oakville (CA)

( * ) Notice: Subject to any disclaimer, the term of this patent is extended or adjusted under 35 U.S.C. 154(b) by 1492 days.

(21) Appl. No.: 11/844,433

(22) Filed: Aug. 24, 2007

(65) Prior Publication Data

US 2009/0050488 A1 Feb. 26, 2009

(51) Int. Cl.
*C25D 17/00* (2006.01)
*C25B 1/00* (2006.01)
*C25C 7/00* (2006.01)

(52) U.S. Cl. ..... 204/280; 204/196.01; 204/285; 204/286.1; 204/288; 204/288.2; 204/289

(58) Field of Classification Search ..... 205/574; 204/196.01, 280, 285, 286.1, 288, 288.2, 204/289

See application file for complete search history.

(56) References Cited

U.S. PATENT DOCUMENTS

| | | | |
|---|---|---|---|
| 4,014,763 | A | 3/1977 | Lowe |
| 4,373,654 | A | 2/1983 | Prengaman et al. |
| 4,479,854 | A | 10/1984 | Willans et al. |
| 4,647,358 | A | 3/1987 | Bartsch et al. |
| 4,882,027 | A | 11/1989 | Borst et al. |
| 5,172,850 | A | 12/1992 | Prengaman et al. |
| 5,492,609 | A | 2/1996 | Assenmacher |
| 5,549,801 | A | 8/1996 | Perlich et al. |
| 5,584,975 | A | 12/1996 | Pohto et al. |
| 5,919,343 | A | 7/1999 | Sparapani |
| 6,569,300 | B1 | 5/2003 | Assenmacher |
| 6,746,581 | B2 | 6/2004 | Ebert |
| 7,003,868 | B2 | 2/2006 | Preimesberger |
| 7,306,706 | B2 | 12/2007 | Robinson et al. |

(Continued)

FOREIGN PATENT DOCUMENTS

| | | |
|---|---|---|
| CA | 2489889 | 12/2003 |

(Continued)

OTHER PUBLICATIONS

Supplementary European Search Report dated Sep. 1, 2010 in respect of corresponding EP Application No. 08783380.2.

*Primary Examiner* — Harry D Wilkins, III
*Assistant Examiner* — Zulmariam Mendez
(74) *Attorney, Agent, or Firm* — Bereskin & Parr LLP/S.E.N.C.R.L., s.r.l.

(57) ABSTRACT

The present invention relates to electrolytic cathode assemblies typically used in the refining or winning of metals and to methods of manufacturing and using same. The cathode assembly comprises an electrically conductive hanger bar and a deposition plate attached along an upper end to the hanger bar to define a joint. The cathode assembly further comprises a protective covering having lateral edges and surrounding the hanger bar and a portion of the upper end of the deposition plate so as to substantially enclose the joint and to leave end portions of the hanger bar exposed outside of the lateral edges of the protective covering. Each end of the protective covering includes a corrosion resistant material positioned to form a substantially continuous seal between the protective covering and the hanger bar, thereby to at least hinder fluid flow into the protective covering. Methods of manufacturing and using the electrolytic cathode assemblies are also described.

25 Claims, 6 Drawing Sheets

U.S. PATENT DOCUMENTS

| | | | |
|---|---|---|---|
| 2003/0010630 | A1 | 1/2003 | Polvi et al. |
| 2006/0102470 | A1 | 5/2006 | Robinson et al. |
| 2007/0051621 | A1 | 3/2007 | Webb |

FOREIGN PATENT DOCUMENTS

| | | | | |
|---|---|---|---|---|
| CA | 2433989 | | | 8/2004 |
| CL | 40588 | | | 3/1996 |
| EP | 0 175 395 | A1 | | 3/1986 |
| EP | 0301115 | | * | 3/1990 |
| EP | 90311692.9 | | | 4/1992 |
| WO | WO 02/097170 | A2 | | 12/2002 |
| WO | WO 03/062497 | | | 7/2003 |
| WO | WO 2005/071142 | | | 8/2005 |
| WO | WO 2006/094355 | A1 | | 9/2006 |

* cited by examiner

ELECTROLYTIC CATHODE ASSEMBLIES AND METHODS OF MANUFACTURING AND USING SAME

FIELD

This specification relates generally to electrolytic cathode assemblies typically used in the refining or winning of metals and to methods of manufacturing and using same.

BACKGROUND

The following paragraphs are not an admission that anything discussed in them is prior art or part of the knowledge of persons skilled in the art.

Electro-refining of metals requires placing an anode made from the crude metal to be refined and a cathode together in a suitable electrolytic bath. Application of a voltage between the anode and the cathode causes the crude metal to oxidize and pure metal ions to go into solution and to migrate electrolytically through the electrolytic bath towards the cathode. The pure metal ions are deposited onto the cathode as a refined metal, usually of very high purity. The majority of the impurities are left behind in the electrolytic bath.

Electro-winning of metals requires placing an anode made from a metal that is different from the metal to be refined and a cathode together in a suitable electrolytic bath. The metal to be refined is added to the electrolytic bath in a soluble form (e.g., prepared from a leaching and solvent extraction process). Application of a voltage between the anode and cathode causes the metal to migrate from the solution and deposit onto the cathode as a refined metal of high purity.

A typical cathode assembly includes a flat deposition plate attached along an upper end to an electrically conductive hanger bar. The hanger bar is in electrical contact with an external power source. Normally, the hanger bar rests on a pair of electrically conductive bus bars that run in parallel along opposite edges of the tank. The hanger bar supports the deposition plate within the electrolytic bath and provides a path for the flow of electricity between the power source and the deposition plate.

After a suitable thickness of refined metal has been deposited onto the surface of the deposition plate, the cathode assembly is removed from the electrolytic bath. In cases where the deposition plate is permanent (e.g., formed from a different metal than the metal to be refined), the refined metal can be recovered by any known stripping techniques. Often, vertical side edges of the deposition plate are covered or protected, so that deposition of copper or other desired metal occurs only on the flat side faces of the deposition plate and around a lower edge thereof.

In some cases, a cathode assembly includes an electrically conductive hanger bar (e.g., copper) coupled together with a permanent deposition plate (e.g., stainless steel). The upper end of the deposition plate is typically inserted into a groove provided along the underside of the hanger bar. The deposition plate is then attached to the hanger bar with a weld. The use of dissimilar metals makes the weld particularly susceptible to galvanic corrosion. This corrosion of this weld may result in a reduction in the conductivity of the assembly and the efficiency of the unit as a whole, and may also contribute to mechanical and structural failure.

Introduction

The following introduction is intended to introduce the reader to this specification but not to define any invention. One or more inventions may reside in a combination or subcombination of the apparatus elements or method steps described below or in other parts of this document. The inventor does not waive or disclaim his rights to any invention or inventions disclosed in this specification merely by not describing such other invention or inventions in the claims.

In one aspect of the specification, there is provided a cathode comprising an electrically conductive hanger bar and a deposition plate attached along an upper end to the hanger bar to define a joint. The cathode assembly further comprises a protective covering having lateral edges and surrounding the hanger bar and a portion of the upper end of the deposition plate so as to substantially enclose the joint and to leave end portions of the hanger bar exposed outside of the lateral edges of the protective covering. Each end of the protective covering includes a corrosion resistant material positioned to form a substantially continuous seal between the protective covering and the hanger bar, thereby to at least hinder fluid flow into the protective covering. It is possible that, for some applications, it may be sufficient to seal the or close off only one end of the protective covering.

The corrosion resistant material may comprise an O-ring, a resin or a tape.

The corrosion resistant material may be positioned around the hanger bar in abutment with one corresponding lateral edge of the protective covering.

Alternatively, each lateral edge of the protective covering is spaced from the hanger bar to form a cavity therebetween and each corrosion resistant material substantially is positioned in a corresponding cavity.

In one aspect, the deposition plate is attached to the hanger bar by at least one weld. In another aspect, the protective covering is attached to the deposition plate by at least one weld. In yet a further aspect, the deposition plate and protective covering are made of stainless steel and the hanger bar is formed from copper.

In one aspect, at each end of the protective covering, a sleeve positioned around and in abutment with a portion of an outer surface of the protective covering and adjacent the corresponding lateral edge and the corresponding adjacent exposed portion of the hanger bar.

In a further aspect of the specification, a method of manufacturing a cathode assembly is described. The method comprises the steps of providing an electrically conductive hanger bar and fastening an upper end of a deposition plate to the hanger bar to form a joint therebetween. The method further comprises the step of providing a protective covering having lateral edges around the hanger bar and a portion of the upper end of the deposition plate so as to substantially enclose the joint and to leave end portions of the hanger bar exposed. The method further comprises the step of at each end of the protective covering, positioning a corrosion resistant material between one lateral edge of the protective covering and one adjacent exposed end portion of the hanger bar to form a seal.

In one aspect, the method further comprises the step of providing the corrosion resistant material as at least one of: an O-ring; a corrosion resistant resin; and a tape.

In another aspect, the method further comprises:

for the O-ring, sliding the O-ring over the hanger bar until it is in abutment with a corresponding lateral edge of the protective covering;

for the corrosion resistant resin, providing a bead of corrosion resistant resin around the corresponding exposed end portion of the hanger bar against the corresponding lateral edge of the protective covering and permitting the corrosion resistant resin to penetrate between the protective covering and the hanger bar; and for the tape, wrapping the tape in multiple layers around the lateral edge of the protective covering and the corresponding exposed portion of the hanger bar adjacent the lateral edge.

In yet a further aspect, each lateral edge of the protective covering is spaced from the hanger bar to form a cavity therebetween and the positioning step (d) is performed by fitting the corrosion resistant material into the cavity.

In one aspect of the specification, a method of refining a metal in an electrolytic cell is described. The method comprises the step of providing a tank containing an electrolytic bath, an anode assembly in the electrolytic bath and a cathode assembly as described herein in the electrolytic bath. The method further comprises the steps of providing a power source and electrically connecting the power source to the anode assembly and the cathode assembly to form the electrolytic cell. The method further comprises the step of applying a sufficient amount of current to the electrolytic cell to cause metal ions from the electrolytic bath to be deposited onto a surface of the deposition plate of the cathode assembly.

In one aspect of the specification, an electrolytic cell is described. The electrolytic cell comprises a tank containing an electrolytic bath, an anode assembly contained within the electrolytic bath, and a cathode assembly as described herein within the electrolytic bath. The electrolytic cell further comprises a power source electrically connected to the anode assembly and the cathode assembly to form the electrolytic cell.

BRIEF DESCRIPTION OF THE DRAWINGS

For a better understanding of the present invention and to show more clearly how it may be carried into effect, reference will now be made, by way of example, to the accompanying drawings which show, by way of example, a preferred embodiment of the present invention and in which.

DETAILED DESCRIPTION

Figure 1:
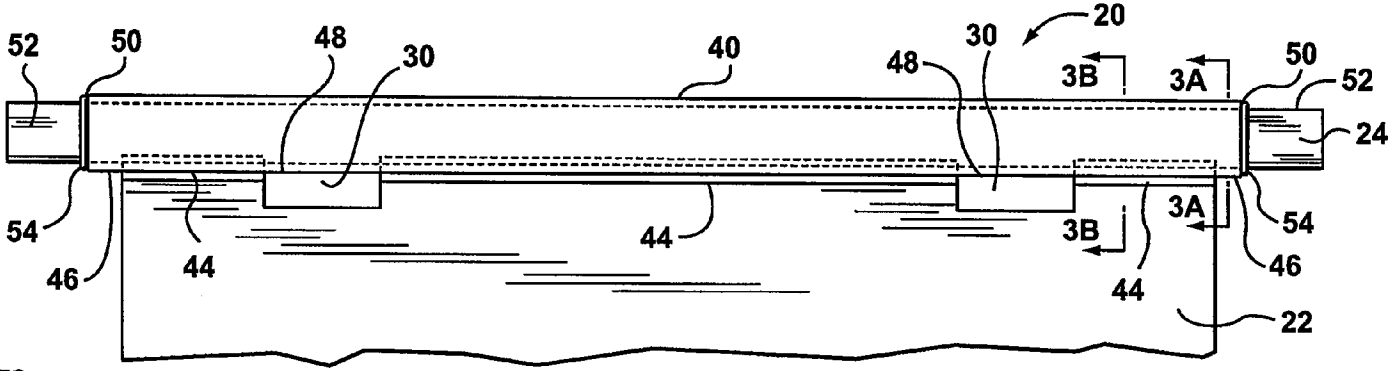
FIG. 1 is a partial elevational view of a cathode assembly in accordance with an a first embodiment of the specification.
Figure 2:
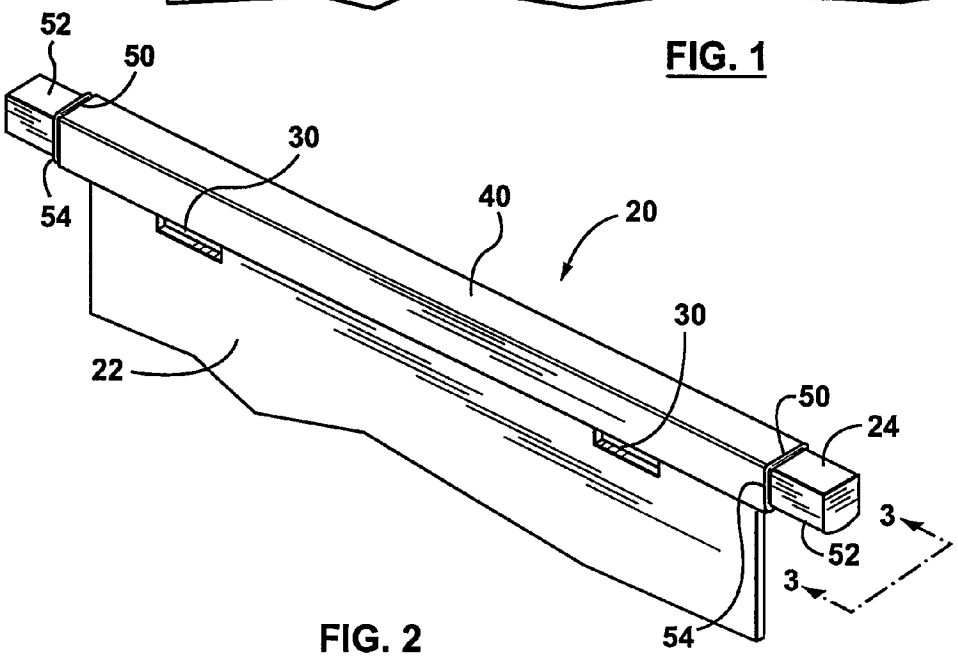
FIG. 2 is a partial perspective view of the cathode assembly shown in FIG. 1.
Figure 3:
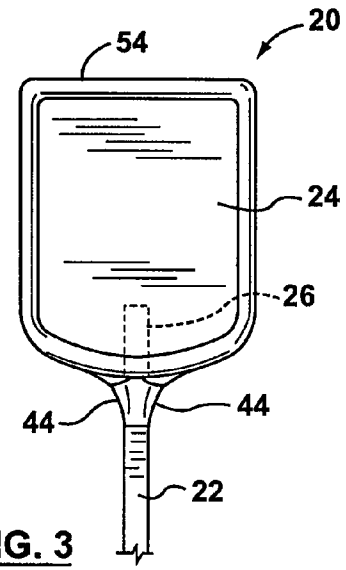
FIG. 3 is a partial end view of the cathode assembly of FIG. 2 as seen from line 3-3.
Figure 3B:
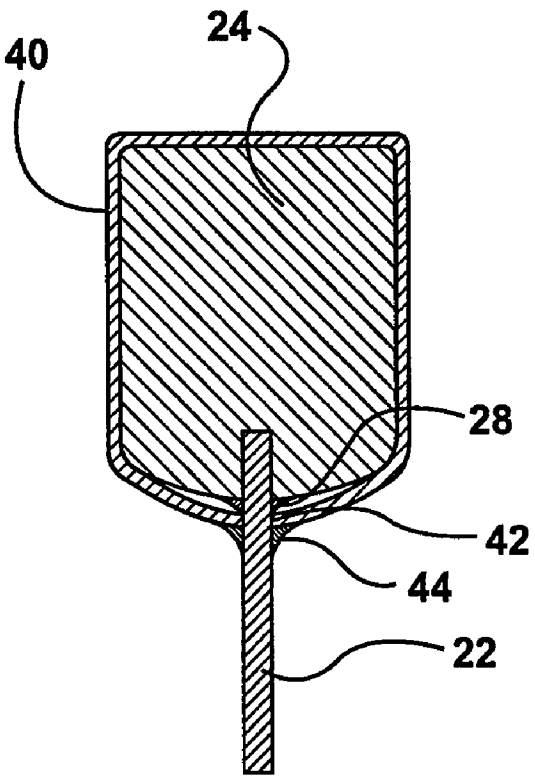
FIGS. 3*a* and 3*b* are, respectively, sectional views along lines 3*a*-3*a* and 3*b*-3*b* of FIG. 1.

Various apparatuses or methods will be described below to provide an example of an embodiment of each claimed invention. No embodiment described below limits any claimed invention and any claimed invention may cover apparatuses or methods that are not described below. The claimed inventions are not limited to apparatuses or methods having all of the features of any one apparatus or method described below or to features common to multiple or all of the apparatuses described below. It is possible that an apparatus or method described below is not an embodiment of any claimed invention. The applicants, inventors and owners reserve all rights in any invention disclosed in an apparatus or method described below that is not claimed in this document and do not abandon, disclaim or dedicate to the public any such invention by its disclosure in this document. FIGS. 1-3 illustrate a cathode assembly generally at 20 according to a first embodiment of the specification. The cathode assembly includes a deposition plate 22 manufactured from an electrically conductive material having a relatively high tensile strength and good corrosion resistance. In the illustrated embodiment, the deposition plate may be manufactured from 316L stainless steel or other alloys with acceptable anti-corrosion properties and with, for example, a "2B" finish. It will be understood that various finishes can be used depending upon the particular application.

The deposition plate 22 is attached to a hanger bar 24. As shown most clearly in FIG. 3, the hanger bar 24 can have a generally flat top and flat sides, and is rounded on the bottom; while a rounded bottom is shown, the bottom could be flat, and in general the profile of the hanger bar can be varied. The hanger bar 24 may be formed from copper.

The deposition plate 22 may be attached to the hanger bar 24, by providing a slot in the hanger bar, as indicated at 26 in FIG. 3, and then welding the plate 22 to the hanger bar 24 as indicated at 28. Alternatively, the deposition plate 22 can be welded directly to the hanger bar 24. As high currents can be present in use and it may be desirable to avoid high current concentrations at individual locations, the deposition plate 22 can be welded to the hanger bar along its entire length on both sides, except for two openings 30. Openings 30 can be provided in the plate 22 to facilitate lifting the cathode assembly out of the tank (not shown). Alternatively, other cathode assemblies can be provided with lifting hooks. It will also be understood that while reference here is made to welding the plate 22 to the hanger bar 24, as these are formed from dissimilar materials, this could be characterized more as a braze than a true welding operation, at least with respect to the stainless steel plate 22.

A protective covering 40 is provided around the hanger bar 24 to cover the weld 28 and to provide additional structural strength. The protective covering 40 is provided closely around the hanger bar, but it may not be so tight as to prevent fluid penetration. Lower edges of the protective covering 42 come into abutment with the deposition plate 22 and are welded thereto as indicated at 44. These welds extend along the entire length of the lower edges 42 where they contact the plate 22.

Figure 3A:
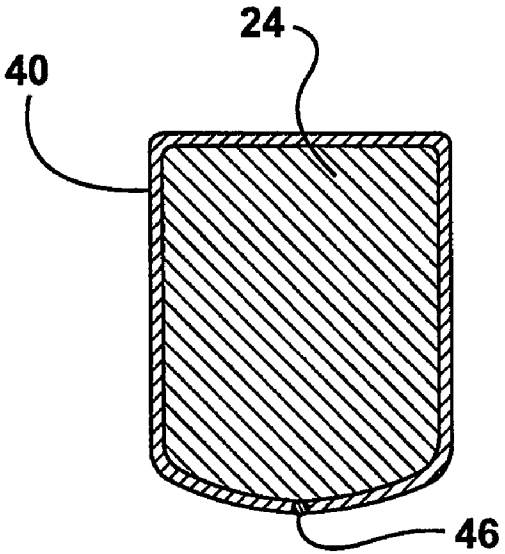

As shown in FIG. 1, the protective covering 40 extends beyond the edges of the deposition plate 22, and the outer parts of the lower edges 42 will face one another directly; if necessary they can be further deformed or pressed so as to abut or be close to one another. Then, additional welds, indicated schematically at 46 are used to close off these portions of the protective covering 40. Additionally, for the portions of the lower edges 42 extending across the openings 30, where required, these can be pressed or deformed so as to be close to or abut one another. Additional welds, indicated schematically at 48 are then provided to close off these parts of the lower edges 42, the welds 48 being similar to welds 46 shown in FIG. 3*a*. Overall, the scheme is such as to ensure that, with respect to the protective covering 40 and the deposition plate 22, there is a continuous weld or seal and no opening is left for penetration of fluid, except at the ends of the covering 40.

Accordingly, there then remains the issue of potential penetration of fluid, e.g. corrosive fluid from the electrolytic bath and/or the cathode wash process between the protective covering 40 and the hanger bar 24, at the ends of the protective covering 40. As indicated at 50, at either end of the protective covering 40, it provides a lateral edge. These lateral edges 50 then leave portions 52 of the hanger bar 24 exposed, at either end of the hanger bar 24.

Figure 4A:
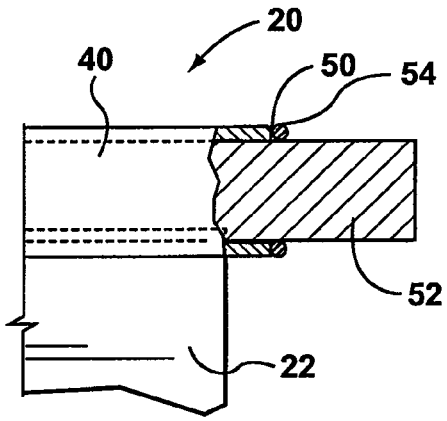
FIGS. 4*a* and 4*b* are enlarged partial cross-sectional views of a lateral end of a cathode assembly shown in FIGS. 1-3.

In accordance with the present invention, a corrosion resistant material is provided at each exposed joint, i.e., a material that is at least resistant to corrosion by liquids used in an electrolytic bath and a cathode wash to which the cathode assembly is exposed in use. In a first embodiment of the present invention, at either end of the protective covering 40, the corrosion resistant material is provided as an O-ring 54 that is slid over the exposed portion 52 of the hanger bar until it abuts the corresponding lateral edge 50, so as to form a fluid seal between the hanger bar 24 and the protective covering 40, as shown in FIG. 4*a*.

Figure 4B:
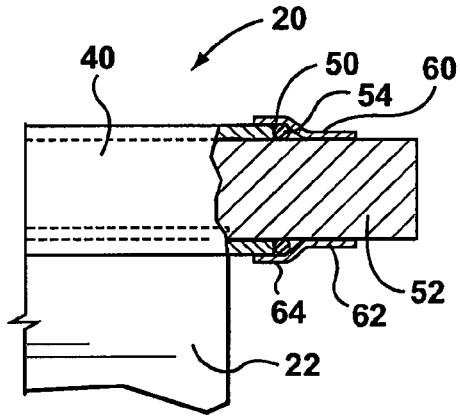

As further shown in FIG. 4*b*, a variant of the first embodiment includes a protective sleeve 60. The protective sleeve 60 can be formed from copper, stainless steel, or any other similar type of material, and it may have the same composition as the copper of the hanger bar 24 or protective covering 40. This sleeve 60 comprises a first portion 62 having a cross-section corresponding to that of the hanger bar 24 and is intended to be a close fit around the hanger bar 24, and a second portion 64, larger than the first portion 62, intended to form a close fit around the protective covering 40 adjacent the lateral edge 50. As shown in FIG. 4*b*, each protective sleeve 60 is slid on from either end of the hanger bar 24, so as to enclose the corresponding lateral edge 50 and O-ring 54, thereby to protect the O-ring. In position, the protective sleeve 60 can be secured to the hanger bar 24, for example, by simply forming small indentations in the protective sleeve 60 that press into the hanger bar 24 and form corresponding mating indentations. In use, no significant loads are applied to the protective sleeve 60, so such a technique should be sufficient to secure each protective sleeve 60 in place. Alternatively, a mechanical screw or weld can be used to fastening the protective sleeve 60 in place.

In use, a close fit between the O-rings 54 and the two lateral edge portions 50 should form a fluid seal that would prevent, or at least hinder or significantly reduce, fluid ingress into any space between the protective covering 40 and the hanger bar 24, thereby to reduce the possibility of fluid reaching the weld 28, between the plate 22 and hanger bar 24, that can be subject to corrosion.

Figure 5A:
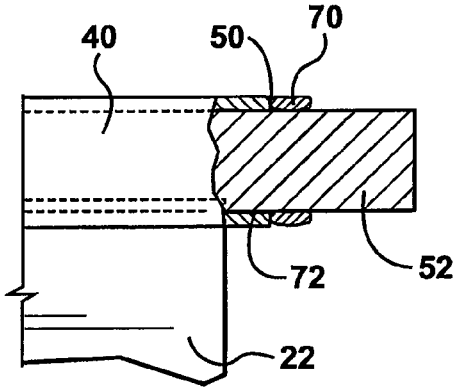
FIGS. 5*a* and 5*b* are enlarged partial cross-sectional views of a lateral end of a cathode assembly in accordance with a second embodiment of the specification.
Figure 5B:
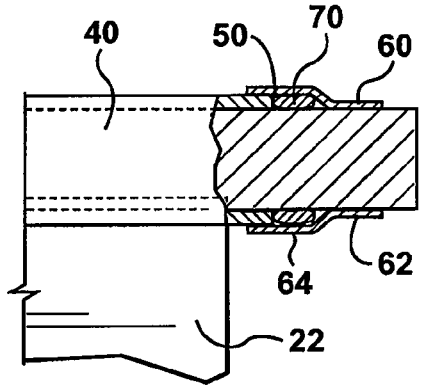
Figure 6A:
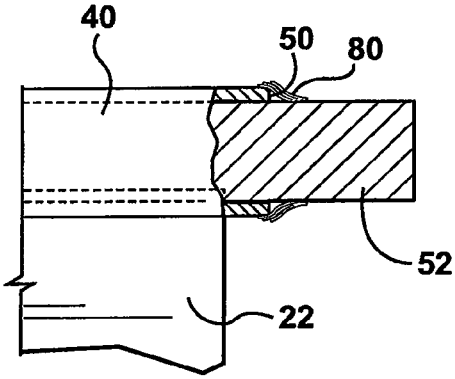
FIGS. 6*a* and 6*b* are enlarged partial cross-sectional views of a lateral end of a cathode assembly in accordance with a third embodiment of the specification.
Figure 6B:
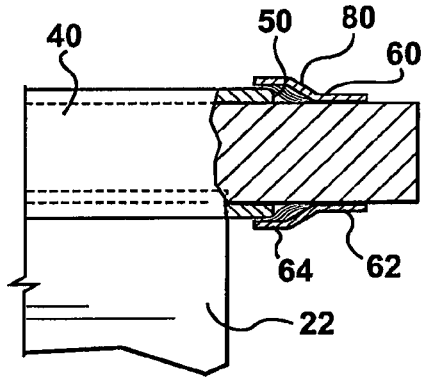
Figure 7:
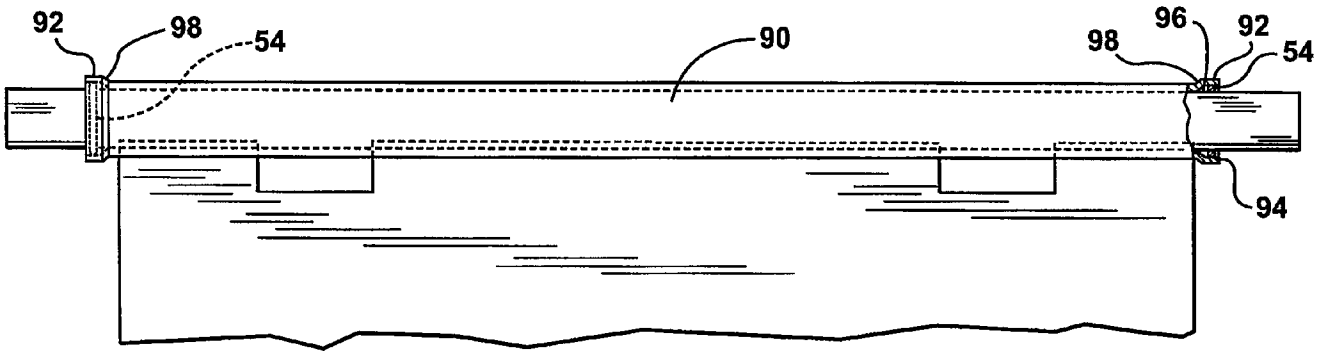
FIG. 7 is a partial elevational view of a cathode assembly in accordance with a fourth embodiment of the specification.
Figure 8:
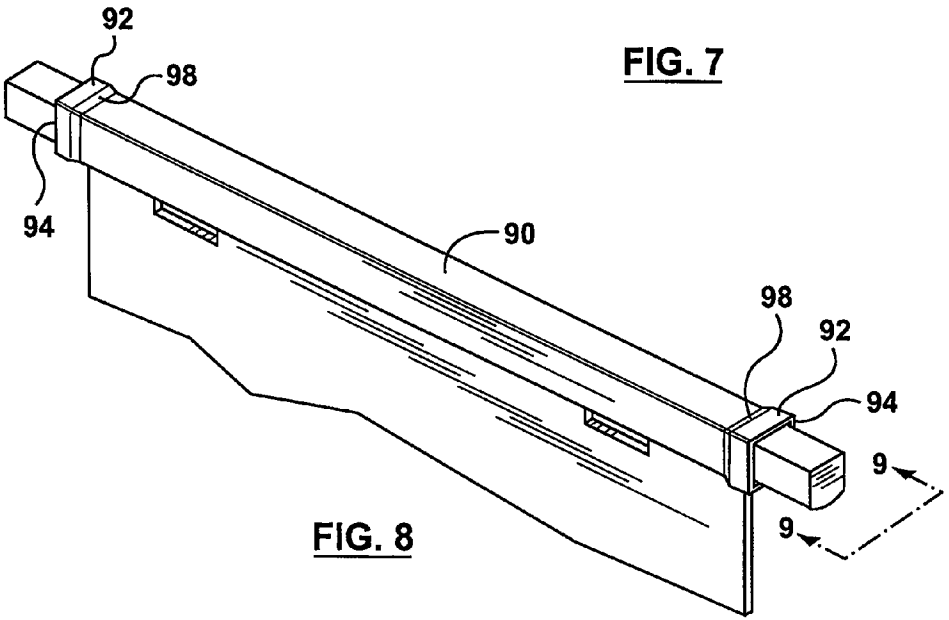
FIG. 8 is a partial perspective view of the cathode assembly shown in FIG. 7.
Figure 9:
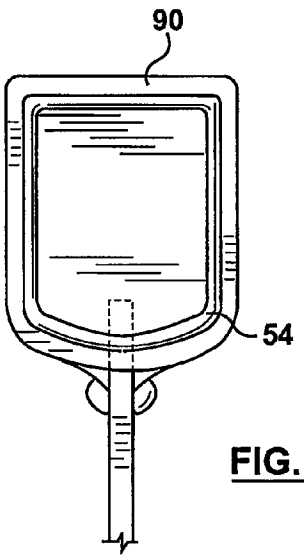
FIG. 9 is a partial end view of the cathode assembly of FIG. 8 as seen from line 9-9.

Referring to FIGS. 5 and 6, these show two further embodiments of the specification, both of which include variants having the protective cover 60 in a similar manner to the first embodiment.

Referring first to FIG. 5, at each lateral edge 50, there is provided a bead or strip of corrosion resistant resin, or other type of epoxy, sealant or adhesive, as indicated at 70. This may be provided in a fluid form, so that it penetrates, e.g. by capillary action between the protective covering 40 and the hanger bar 24, as indicated at 72.

As for the first embodiment, FIG. 5*b* shows a variant in which the corrosion resistant resin bead 70 at each end is protected by a protective cover 60, this generally corresponding to that shown in FIG. 4*b*. Depending upon the dimensions of the material applied, the dimensions of the protective cover 60 can be adjusted accordingly.

FIG. 6*a* shows a third embodiment, in which a tape 80 that is corrosion resistant is wrapped around each end of the protective covering 40. The tape 80 may have the characteristics of being self-adhering or otherwise not requiring a separate adhesive layer to retain it in place. Sufficient layers of the tape 80 are wound around each lateral edge 50 and the adjacent surface of the corresponding exposed portion 52 of the hanger bar, so as to seal or to close off any gap between the protective covering 40 and the hanger bar 24. For example, the tape 80 can be a formed from polytetrafluoroethylene (PTFE) manufactured by E.I. Dupont and sold under the trademark Teflon™ or it may be in the form of a silicone tape.

Again, as for the first two embodiments, the tape 80 at each joint can be protected with a protective sleeve 60. As for the other embodiments, the protective sleeve 60 can be dimensioned accordingly.

Reference now will be made to FIGS. 7-12 that show the fourth, fifth and sixth embodiments of the specification, with variance thereof. For simplicity and brevity, like components are given the same reference numeral, and the description of these components is not repeated. It is to be understood that, at least in some instances, some of these components may need some changes in dimensions, etc., to accommodate these difference embodiments and variants, but otherwise function similarly as in the earlier embodiments.

In FIGS. 7-12, the protective covering is denoted by the reference 90, and is provided with enlarged end portions 92. Consequently, lateral edges, now indicated at 94, are spaced from the exposed hanger bar end portions 52. This spacing defines cavities 96 at either end of the protective covering 90.

As shown in FIGS. 7, 8, 9 and 10, in a first embodiment, the O-ring 54 is now positioned within the cavity 96 at each end, for the purpose of forming a seal. It can be noted that the enlarged end portions 92 are connected to the main or central part of the protective cover by tapered sections indicated at 98. For some applications, it may prove beneficial to press the O-rings 54 into these tapered sections 98 to enhance the sealing effect, and the taper of the tapered sections 98 can be adjusted accordingly.

Figure 10A:
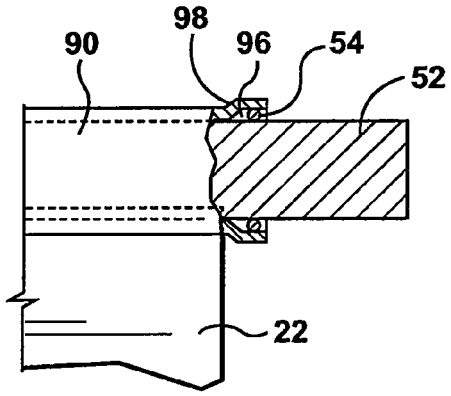
FIGS. 10*a* and 10*b* are enlarged partial cross-sectional views of a lateral end of a cathode assembly shown in FIGS. 7-9.
Figure 10B:
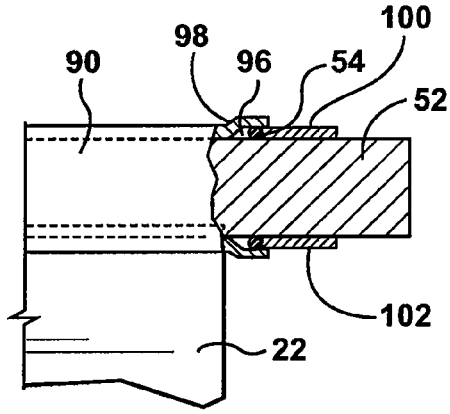

As shown in FIG. 10*b*, a variant as in the earlier embodiments provides a protective sleeve, indicated at 100. The protective sleeve 100 has a small cross-section that can generally corresponds to the portion 62 of the earlier protective sleeve 60. Again, the sleeve 100 can be dimensioned so as to be a close fit with the hanger bar 24, and it may be secured or attached to the corresponding exposed end portion of the hanger bar 52 as before.

Figure 11A:
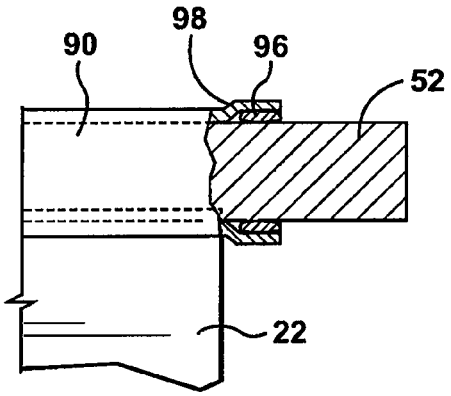
FIGS. 11*a* and 11*b* are enlarged partial cross-sectional views of a lateral end of a cathode assembly in accordance with a fifth embodiment of the specification.
Figure 11B:
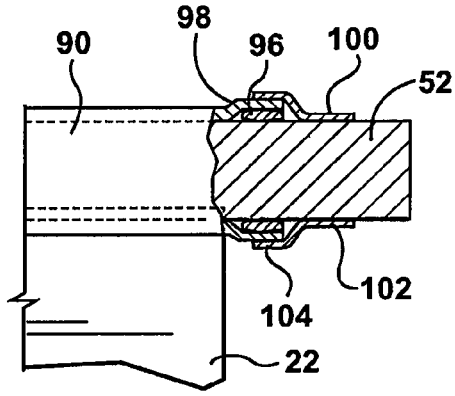

With a reference to FIGS. 11*a* and 11*b*, here, a bead of corrosion resistant resin, or any other type of epoxy, adhesive or sealant 70, is now provided, at each end of the protective covering 90, within the cavities 96. The tapered section 98 at each end of the protective covering 90 can be dimensioned to promote penetration of the epoxy resin or other material 70 into any gap between the protective covering 90 and the hanger bar 24.

As shown in FIG. 11*b*, a protective sleeve 100 can be provided, to protect the seal formed by the corrosion resistant resin 70, at each end of the protective covering 90.

Figure 12A:
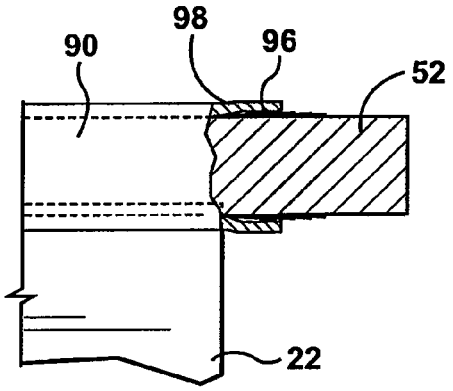
FIGS. 12*a* and 12*b* are enlarged partial cross-sectional views of a lateral end of a cathode assembly in accordance with a sixth embodiment of the specification.
Figure 12B:
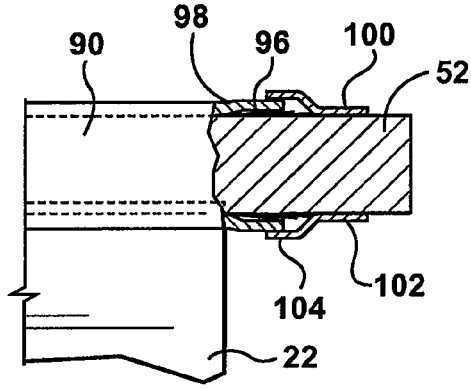

Finally, FIGS. 12*a* and 12*b*, a tape seal 80 is provided, the tape 80 is built up in sufficient layers so as to form a seal between the enlarged end portion 92 and the hanger bar 24, at both ends of the protective covering 90. Note here that the enlarged end portion 92 can have a closer spacing with the hanger bar 24.

To protect the tape seal 80, at each end of the protective covering 90, the protective sleeve 100 can be provided, as shown in FIG. 12*b*.

Figure 13:
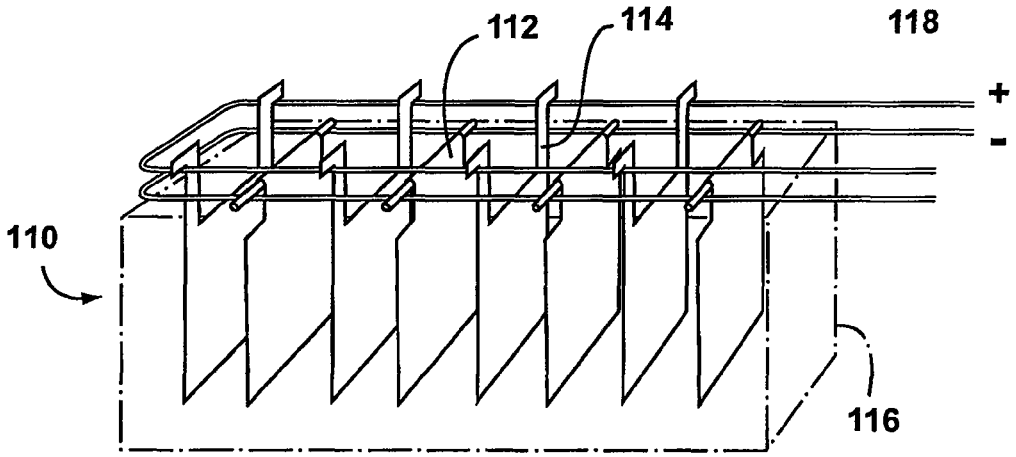
FIG. 13 is a schematic, perspective view of an exemplary electrolytic cell.

Referring to FIG. 13 there is shown an electrolytic cell arrangement indicated generally by the reference 110. Here, anodes 112 and cathodes 114 are suspended in a tank 116. Generally similar arrangements are used for electro-winning and electro-refining. For electro-winning, a solution is provided which the desired metal, e.g., copper, is in a solution. Electrolysis is then used to cause the copper or the desired metal to deposit on the cathodes. In electro-refining, metal already recovered, e.g. again copper, is provided as the anode, and by way of electrolysis is caused to go into solution and then deposit on the cathodes; the electro-refining operation has conditions set to encourage deposition of the desired copper on the cathodes, while leaving other undesired metals and other materials in solution, or otherwise not deposited on the cathodes.

Here, the anodes and cathodes 112, 114 are indicated. Connections to a power source (not shown) are indicated at 118. The electrolytic solution or bath would be chosen to be suitable for the particular operation, e.g. electro-winning or electro-refining, and would be maintained at desired temperatures, etc.

Although particular embodiments of one or more inventions have been described in detail herein with reference to the accompanying drawings, it is to be understood that each claimed invention is not limited to those particular embodiments, and that various changes and modifications may be effected therein by one skilled in the art without departing from the scope or spirit of any invention as defined in the appended claims.

The invention claimed is:

1. A cathode assembly, comprising:

a) an electrically conductive hanger bar;

b) a deposition plate attached along an upper end to the hanger bar to define a joint;

c) a protective covering having lateral edges and surrounding the hanger bar and a portion of the upper end of the deposition plate so as to substantially enclose the joint and to leave end portions of the hanger bar exposed outside of the lateral edges of the protective covering; and d) at each lateral edge of the protective covering, a corrosion resistant material positioned around the hanger bar to form a substantially continuous seal between the protective covering and the hanger bar, thereby to at least hinder fluid flow into the protective covering.

2. An assembly according to claim 1, wherein each corrosion resistant material comprises an O-ring.

3. An assembly according to claim 2, wherein each O-ring is positioned around the hanger bar in abutment with one corresponding lateral edge of the protective covering.

4. An assembly according to claim 2, wherein each lateral edge of the protective covering is spaced from the hanger bar to form a cavity therebetween and each O-ring substantially is positioned in a corresponding cavity.

5. An assembly according to claim 1, wherein the corrosion resistant material comprises a corrosion resistant resin.

6. An assembly according to claim 5, wherein the corrosion resistant resin is positioned around the hanger bar in abutment with one corresponding lateral edge of the protective covering.

7. An assembly according to claim 5, wherein each lateral edge of the protective covering is spaced from the hanger bar to form a cavity therebetween and, at each end of the protective covering, the corrosion resistant resin substantially fills the cavity.

8. An assembly according to claim 1, wherein the corrosion resistant material comprises tape.

9. An assembly according to claim 8, wherein, at each end of the protective covering, the tape is wrapped around a portion of the protective covering adjacent the corresponding lateral edge, and a part of the adjacent exposed portion of the hanger bar.

10. An assembly according to claim 8, wherein each lateral edge of the protective covering is spaced from the hanger bar to form a cavity therebetween and, at each end of the protective covering, the tape is wrapped around an outer surface of the hanger bar so that it substantially fills the cavity.

11. An assembly according to claim 1, wherein the deposition plate is attached to the hanger bar by at least one weld.

12. An assembly according to claim 11, wherein the protective covering is attached to the deposition plate by at least one weld.

13. An assembly according to claim 12, wherein the deposition plate and protective covering are made of stainless steel and the hanger bar is formed from copper.

14. An assembly according to claim 1, further comprising, at each end of the protective covering, a sleeve positioned around and in abutment with a portion of an outer surface of the protective covering and adjacent the corresponding lateral edge and the corresponding adjacent exposed portion of the hanger bar.

15. A method of manufacturing a cathode assembly, comprising:

providing an electrically conductive hanger bar;

fastening an upper end of a deposition plate to the hanger bar to form a joint therebetween;

providing a protective covering having lateral edges around the hanger bar and a portion of the upper end of the deposition plate so as to substantially enclose the joint and to leave end portions of the hanger bar exposed; and at each lateral edge of the protective covering, positioning a corrosion resistant material around the hanger bar between the lateral edge of the protective covering and the adjacent exposed end portion of the hanger bar to form a seal.

16. A method according to claim 15, further comprising providing the corrosion resistant material as at least one of: an O-ring; a corrosion resistant resin; and a tape.

17. A method according to claim 16, the method comprising:

for the O-ring, sliding the O-ring over the hanger bar until it is in abutment with a corresponding lateral edge of the protective covering;

for the corrosion resistant resin, providing a bead of corrosion resistant resin around the corresponding exposed end portion of the hanger bar against the corresponding lateral edge of the protective covering and permitting the corrosion resistant resin to penetrate between the protective covering and the hanger bar; and for the tape, wrapping the tape in multiple layers around the lateral edge of the protective covering and the corresponding exposed portion of the hanger bar adjacent the lateral edge.

18. A method according to claim 15, wherein each lateral edge of the protective covering is spaced from the hanger bar to form a cavity therebetween, and the positioning step is performed by fitting the corrosion resistant material into the cavity.

19. A method according to claim 15, wherein the fastening step is performed by attaching the deposition plate to the hanger bar by at least one weld.

20. A method according to claim 15, further comprising the step of attaching the protective covering to the deposition plate by at least one weld.

21. A method according to claim 15, further comprising forming the deposition plate and protective covering from stainless steel.

22. A method according to claim 15, further comprising, at each end of the protective covering, positioning a sleeve around a portion of an outer surface of the lateral edge of the protective covering and around the adjacent exposed portion of the hanger bar.

23. A method of electro-refining or electro-winning a metal in an electrolytic cell, the method comprising:

providing a tank containing an electrolytic bath;

providing an anode assembly in the electrolytic bath;

providing a cathode assembly as claimed in claim 1 in the electrolytic bath;

providing a power source;

electrically connecting the power source to the anode assembly and the cathode assembly to form the electrolytic cell; and applying a sufficient amount of current to the electrolytic cell to cause metal ions from the electrolytic bath to be deposited onto a surface of the deposition plate of the cathode assembly.

24. A method as claimed in claim 23, wherein the metal ions deposited on the deposition plate comprise copper.

25. An electrolytic cell, comprising:

a tank containing an electrolytic bath;

an anode assembly contained within the electrolytic bath;

a cathode assembly as claimed in claim 1 contained within the electrolytic bath; and a power source electrically connected to the anode assembly and the cathode assembly to form the electrolytic cell.

* * * * *